US008719011B2

(12) United States Patent
Morii et al.

(10) Patent No.: US 8,719,011 B2
(45) Date of Patent: May 6, 2014

(54) ENCODING DEVICE AND ENCODING METHOD

(75) Inventors: Toshiyuki Morii, Kanagawa (JP); Masahiro Oshikiri, Kanagawa (JP); Tomofumi Yamanashi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 468 days.

(21) Appl. No.: 12/529,219

(22) PCT Filed: Feb. 29, 2008

(86) PCT No.: PCT/JP2008/000397
§ 371 (c)(1),
(2), (4) Date: Aug. 31, 2009

(87) PCT Pub. No.: WO2008/108076
PCT Pub. Date: Sep. 12, 2008

(65) Prior Publication Data

US 2010/0057446 A1 Mar. 4, 2010

(30) Foreign Application Priority Data

Mar. 2, 2007 (JP) ..... 2007-053497

(51) Int. Cl.
*G10L 21/00* (2013.01)

(52) U.S. Cl.
USPC ..... 704/219; 704/200; 704/200.1; 704/500; 704/501

(58) Field of Classification Search
USPC ..... 704/200–201, 500–503, 219
See application file for complete search history.

(56) References Cited

U.S. PATENT DOCUMENTS

| | | | | |
|---|---|---|---|---|
| 5,473,727 | A * | 12/1995 | Nishiguchi et al. | 704/222 |
| 5,819,212 | A * | 10/1998 | Matsumoto et al. | 704/219 |
| 6,192,334 | B1 | 2/2001 | Nomura | |
| 6,236,961 | B1 | 5/2001 | Ozawa | |
| 6,353,808 | B1 * | 3/2002 | Matsumoto et al. | 704/230 |
| 6,401,062 | B1 | 6/2002 | Murashima | |
| 7,630,882 | B2 * | 12/2009 | Mehrotra et al. | 704/205 |
| 7,752,052 | B2 * | 7/2010 | Oshikiri | 704/500 |
| 7,979,271 | B2 * | 7/2011 | Bessette | 704/219 |

(Continued)

FOREIGN PATENT DOCUMENTS

| | | |
|---|---|---|
| EP | 0869477 | 10/1998 |
| JP | 5-113799 | 5/1993 |

(Continued)

OTHER PUBLICATIONS

English language Abstract of JP 11-237899, Aug. 31, 1999.

(Continued)

*Primary Examiner* — Douglas Godbold
(74) *Attorney, Agent, or Firm* — Greenblum & Bernstein, P.L.C.

(57) ABSTRACT

Provided is an encoding device which can obtain a sound quality preferable for auditory sense even if the number of information bits is small. The encoding device includes a shape quantization unit (111) having: a section search unit (121) which searches for a pulse for each of bands into which a predetermined search section is divided; and a whole search unit (122) which performs search for a pulse over the entire search section. The shape of an input spectrum is quantized by a small number of pulse positions and polarities. A gain quantization unit (112) calculates a gain of the pulse searched by the shape quantization unit (111) and quantizes the gain for each of the bands.

8 Claims, 8 Drawing Sheets

(56) References Cited

U.S. PATENT DOCUMENTS

| | | | | |
|---|---|---|---|---|
| 2002/0016161 | A1* | 2/2002 | Dellien et al. | 455/403 |
| 2002/0095285 | A1 | 7/2002 | Murashima | |
| 2004/0128130 | A1* | 7/2004 | Rose et al. | 704/236 |
| 2008/0077413 | A1 | 3/2008 | Egichi | |
| 2008/0243518 | A1* | 10/2008 | Oraevsky et al. | 704/500 |
| 2008/0275709 | A1* | 11/2008 | Den Brinker et al. | 704/500 |
| 2009/0055169 | A1 | 2/2009 | Goto et al. | |
| 2009/0070107 | A1* | 3/2009 | Kawashima et al. | 704/229 |
| 2009/0076809 | A1 | 3/2009 | Yoshida | |
| 2009/0083041 | A1* | 3/2009 | Yoshida | 704/500 |
| 2009/0119111 | A1 | 5/2009 | Goto et al. | |
| 2009/0306992 | A1* | 12/2009 | Ragot et al. | 704/500 |

FOREIGN PATENT DOCUMENTS

| | | |
|---|---|---|
| JP | 7-261800 | 10/1995 |
| JP | 10-260698 | 9/1998 |
| JP | 10-340098 | 12/1998 |
| JP | 11-237899 | 8/1999 |
| JP | 11-249698 | 9/1999 |
| JP | 2008-83295 | 4/2008 |

OTHER PUBLICATIONS

English language Abstract of JP 11-249698, Sep. 17, 1999.
English language Abstract of JP 2008-83295, Apr. 10, 2008.
English language Abstract of JP 10-260698, Sep. 29, 1998.
English language Abstract of JP 7-261800, Oct. 13, 1995.
Xie et al., "Embedded Algebraic Vector Quantizers (EAVQ) With Application to Wideband Speech Coding," ICASSP' 96, pp. 240-243.
Moriya et al., "Transform Coding of Speech Using a Weighted Vector Quantizer," IEEE Journal on selected areas in communications, vol. 6, No. 2, Feb. 1988, pp. 425-431.
U.S. Appl. No. 12/529,212 to Oshikiri, filed Aug. 31, 2009.
U.S. Appl. No. 12/528,661 to Sato et al, filed Aug. 26, 2009.
U.S. Appl. No. 12/528,671 to Kawashima et al, filed Aug. 26, 2009.
U.S. Appl. No. 12/528,869 to Oshikiri et al, filed Aug. 27, 2009.
U.S. Appl. No. 12/528,659 to Oshikiri et al, filed Aug. 26, 2009.
U.S. Appl. No. 12/529,877 to Morii et al, filed Aug. 27, 2009.
U.S. Appl. No. 12/528,871 to Morii et al, filed Aug. 27, 2009.
U.S. Appl. No. 12/528,878 to Ehara, filed Aug. 27, 2009.
U.S. Appl. No. 12/528,880 to Ehara, filed Aug. 27, 2009.
Search report from E.P.O., mail date is Feb. 9, 2012.

* cited by examiner

ENCODING DEVICE AND ENCODING METHOD

TECHNICAL FIELD

The present invention relates to a coding apparatus and coding method for encoding speech signals and audio signals.

BACKGROUND ART

In mobile communications, it is necessary to compress and encode digital information such as speech and images for efficient use of radio channel capacity and storage media for radio waves, and many coding and decoding schemes have been developed so far.

Among these, the performance of speech coding technology has been improved significantly by the fundamental scheme of "CELP (Code Excited Linear Prediction)," which skillfully adopts vector quantization by modeling the vocal tract system of speech. Further, the performance of sound coding technology such as audio coding has been improved significantly by transform coding techniques (such as MPEG-standard ACC and MP3).

On the other hand, a scalable codec, the standardization of which is in progress by ITU-T (International Telecommunication Union—Telecommunication Standardization Sector) and others, is designed to cover from the conventional speech band (300 Hz to 3.4 kHz) to wideband (up to 7 kHz), with its bit rate set as high as up to approximately 32 kbps. That is, a wideband codec has to even apply a certain degree of coding to audio and therefore cannot be supported by only conventional, low-bit-rate speech coding methods based on the human voice model, such as CELP. Now, ITU-T standard G.729.1, declared earlier as a recommendation, uses an audio codec coding scheme of transform coding, to encode speech of wideband and above.

Patent Document 1 discloses a coding scheme utilizing spectral parameters and pitch parameters, whereby an orthogonal transform and coding of a signal acquired by inverse-filtering a speech signal are performed based on spectral parameters, and furthermore discloses, as an example of coding, a coding method based on codebooks of algebraic structures.

Patent Document 2 discloses a coding scheme of dividing a signal into the linear prediction parameters and the residual components, performing quadrature transform of the residual components and normalizing the residual waveform by the power, and then quantizing the gain and the normalized residue. Further, Patent Document 2 discloses vector quantization as a quantization method for normalized residue.

Non-Patent Document 1 discloses a coding method based on an algebraic codebook formed with improved excitation spectrums in TCX (i.e. a fundamental coding scheme modeled with an excitation subjected to transform coding and filtering of spectral parameters), and this coding method is adopted in ITU-T standard G.729.1.

Non-Patent Document 2 discloses description of the MPEG-standard scheme, "TC-WVQ." This scheme is also used to transform linear prediction residue into a spectrum and perform vector quantization of the spectrum, using the DCT (Discrete Cosine Transform) as the orthogonal transform method.

By means of the above four prior arts, it is possible to apply, to coding, quantization of spectral parameters such as linear prediction parameters, which is part of a useful coding technique of speech signals, thereby enabling the efficiency and low rate of audio coding to be realized.

Patent Document 1: Japanese Patent Application Laid-Open No. HEI10-260698

Patent Document 2: Japanese Patent Application Laid-Open No. HEI07-261800

Non-Patent Document 1: Xie, Adoul, "EMBEDDED ALGEBRAIC VECTOR QUANTIZERS (EAVQ) WITH APPLICATION TO WIDEBAND SPEECH CODING" ICASSP'96

Non-Patent Document 2: Moriya, Honda, "Transform Coding of Speech Using a Weighted Vector Quantizer" IEEE journal on selected areas in communications, Vol. 6, No. 2, February 1988

DISCLOSURE OF INVENTION

Problems to be Solved by the Invention

However, the number of bits to be assigned by a scalable codec is small especially in a relatively lower layer, and, consequently, the performance of excitation transform coding is not sufficient. For example, in ITU-T standard G.729.1, although a bit rate is 12 kbps in the second or lower layer supporting the telephone band (300 Hz to 3.4 kHz), only a bit rate of 2 kbps is assigned to the next, third layer supporting a wideband (50 Hz to 7 kHz). Thus, when there are few information bits, it is not possible to achieve sufficient perceptual performance by using a method of encoding a spectrum, which is acquired by an orthogonal transform, with vector quantization using a codebook.

It is therefore an object of the present invention to provide a coding apparatus and coding method that can achieve good perceptual quality even if there are few information bits.

Means for Solving the Problem

The coding apparatus of the present invention employs a configuration having: a shape quantizing section that encodes a shape of a frequency spectrum; and a gain quantizing section that encodes a gain of the frequency spectrum, and in which the shape quantizing section includes: an interval search section that searches for a first fixed waveform in each of a plurality of bands dividing a predetermined search interval; and a thorough search section that searches for second fixed waveforms over an entirety of the predetermined search interval.

The coding method of the present invention includes the steps of: a shape quantizing step of encoding a shape of a frequency spectrum; and a gain quantizing step of encoding a gain of the frequency spectrum, and in which the shape quantizing step includes: an interval searching step of searching for a first fixed waveform in a plurality of bands dividing a predetermined search interval; and a thorough searching step of searching for second fixed waveforms over an entirety of the predetermined search interval.

Advantageous Effects of Invention

According to the present invention, it is possible to accurately encode frequencies (positions) where energy is present, so that it is possible to improve qualitative performance, which is unique to spectrum coding, and produce good sound quality even at low bit rates.

BEST MODE FOR CARRYING OUT THE INVENTION

In speech signal coding based on the CELP scheme and others, a speech signal is often represented by an excitation and synthesis filter. If a vector having a similar shape to an excitation signal, which is a time domain vector sequence, can be decoded, it is possible to produce a waveform similar to input speech through a synthesis filter, and achieve good perceptual quality. This is the qualitative characteristic that has lead to the success of the algebraic codebook used in CELP.

On the other hand, in the case of frequency spectrum (vector) coding, a synthesis filter has spectral gains as its components, and therefore the distortion of the frequencies (i.e. positions) of components of large power is more significant than the distortion of these gains. That is, by searching for positions of high energy and decoding the pulses at the positions of high energy, rather than decoding a vector having a similar shape to an input spectrum, it is more likely to achieve good perceptual quality.

The present inventors focused on this point and arrived at the present invention. That is, based on a model of encoding a frequency spectrum by a small number of pulses, the present invention transforms a speech signal to encode (i.e. time domain vector sequence) into a frequency domain signal by an orthogonal transform, divides the frequency interval of the coding target into a plurality of bands, and searches for one pulse in each band, and, in addition, searches for several pulses over the entire frequency interval of the coding target.

Further, the present invention separates shape (form) quantization and gain (amount) quantization, and, in shape quantization, assumes an ideal gain and searches for pulses having an amplitude "1" and a polarity "+" or "−," in an open loop. Here, especially upon a search over the entire frequency interval of the coding target, the present invention does not allow two pulses to occur in the same position and allows combinations of the positions of a plurality of pulses to be encoded as transmission information about pulse positions.

An embodiment of the present invention will be explained below using the accompanying drawings.

Figure 1:
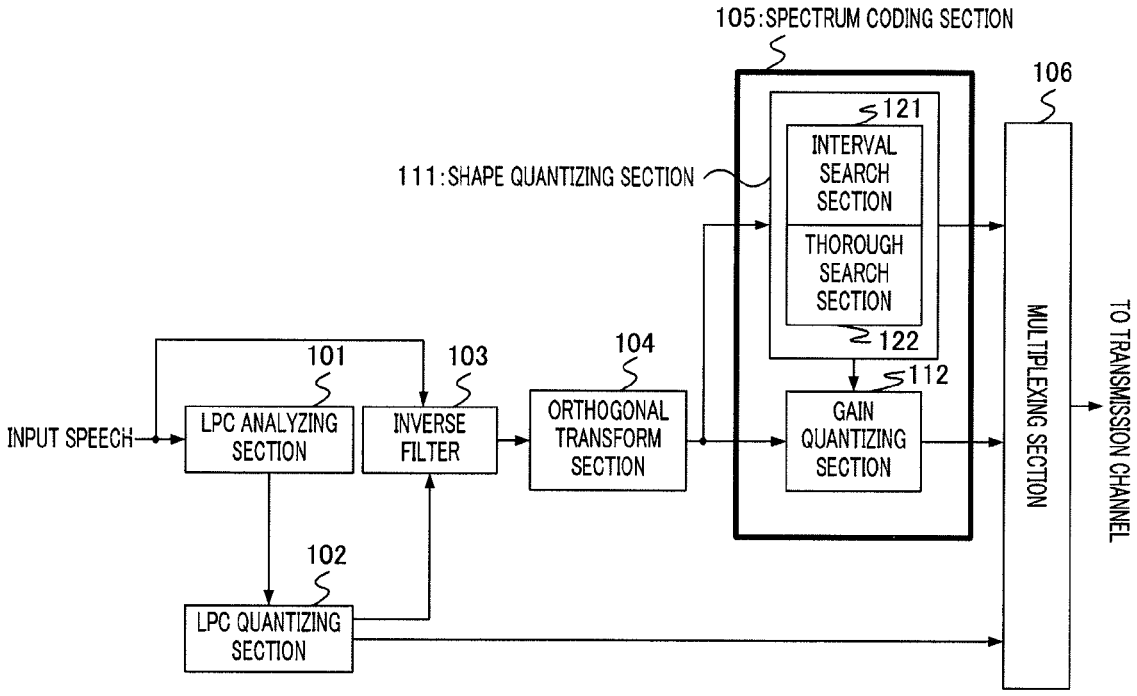
FIG. 1 is a block diagram showing the configuration of a speech coding apparatus according to an embodiment of the present invention.

FIG. 1 is a block diagram showing the configuration of the speech coding apparatus according to the present embodiment. The speech coding apparatus shown in FIG. 1 is provided with LPC analyzing section 101, LPC quantizing section 102, inverse filter 103, orthogonal transform section 104, spectrum coding section 105 and multiplexing section 106. Spectrum coding section 105 is provided with shape quantizing section 111 and gain quantizing section 112.

LPC analyzing section 101 performs a linear prediction analysis of an input speech signal and outputs a spectral envelope parameter to LPC quantizing section 102 as an analysis result. LPC quantizing section 102 performs quantization processing of the spectral envelope parameter (LPC: Linear Prediction Coefficient) outputted from LPC analyzing section 101, and outputs a code representing the quantization LPC, to multiplexing section 106. Further, LPC quantizing section 102 outputs decoded parameters acquired by decoding the code representing the quantized LPC, to inverse filter 103. Here, the parameter quantization may employ vector quantization ("VQ"), prediction quantization, multi-stage VQ, split VQ and other modes.

Inverse filter 103 inverse-filters input speech using the decoded parameters and outputs the resulting residual component to orthogonal transform section 104.

Orthogonal transform section 104 applies a match window, such as a sine window, to the residual component, performs an orthogonal transform using MDCT, and outputs a spectrum transformed into a frequency domain spectrum (hereinafter "input spectrum"), to spectrum coding section 105. Here, the orthogonal transform may employ other transforms such as the FFT, KLT and Wavelet transform, and, although their usage varies, it is possible to transform the residual component into an input spectrum using any of these.

Here, the order of processing between inverse filter 103 and orthogonal transform section 104 may be reversed. That is, by dividing input speech subjected to an orthogonal transform by the frequency spectrum of an inverse filter (i.e. subtraction in logarithmic axis), it is possible to produce the same input spectrum.

Spectrum coding section 105 divides the input spectrum by quantizing the shape and gain of the spectrum separately, and outputs the resulting quantization codes to multiplexing section 106. Shape quantizing section 111 quantizes the shape of the input spectrum using a small number of pulse positions and polarities, and gain quantizing section 112 calculates and quantizes the gains of the pulses searched out by shape quantizing section 111, on a per band basis. Shape quantizing section 111 and gain quantizing section 112 will be described later in detail.

Multiplexing section 106 receives as input a code representing the quantization LPC from LPC quantizing section 102 and a code representing the quantized input spectrum from spectrum coding section 105, multiplexes these information and outputs the result to the transmission channel as coding information.

Figure 2:
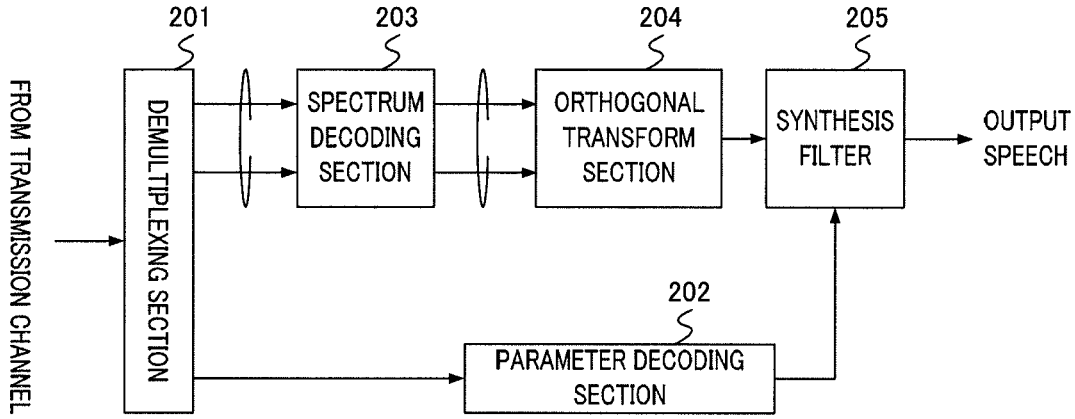
FIG. 2 is a block diagram showing the configuration of a speech decoding apparatus according to an embodiment of the present invention.

FIG. 2 is a block diagram showing the configuration of the speech decoding apparatus according to the present embodiment. The speech decoding apparatus shown in FIG. 2 is provided with demultiplexing section 201, parameter decoding section 202, spectrum decoding section 203, orthogonal transform section 204 and synthesis filter 205.

In FIG. 2, coding information is demultiplexed into individual codes in demultiplexing section 201. The code representing the quantized LPC is outputted to parameter decoding section 202, and the code of the input spectrum is outputted to spectrum decoding section 203.

Parameter decoding section 202 decodes the spectral envelope parameter and outputs the resulting decoded parameter to synthesis filter 205.

Spectrum decoding section 203 decodes the shape vector and gain by the method supporting the coding method in spectrum coding section 105 shown in FIG. 1, acquires a decoded spectrum by multiplying the decoded shape vector by the decoded gain, and outputs the decoded spectrum to orthogonal transform section 204.

Orthogonal transform section 204 performs an inverse transform of the decoded spectrum outputted from spectrum decoding section 203 compared to orthogonal transform section 104 shown in FIG. 1, and outputs the resulting, time-series decoded residual signal to synthesis filter 205.

Synthesis filter 205 produces output speech by applying synthesis filtering to the decoded residual signal outputted from orthogonal transform section 204 using the decoded parameter outputted from parameter decoding section 202.

Here, to reverse the order of processing between inverse filter 103 and orthogonal transform section 104 shown in FIG. 1, the speech decoding apparatus in FIG. 2 multiplies the decoded spectrum by a frequency spectrum of the decoded parameter (i.e. addition in the logarithmic axis) and performs an orthogonal transform of the resulting spectrum.

Next, shape quantizing section 111 and gain quantizing section 112 will be explained in detail. Shape quantizing section 111 is provided with interval search section 121 that searches for pulses in each of a plurality of bands a predetermined search interval is divided into, and thorough search section 122 that searches for pulses over the entire search interval.

Following equation 1 provides a reference for search. Here, in equation 1, E is the coding distortion, $s_i$ is the input spectrum, g is the optimal gain, δ is the delta function, and p is the pulse position.

[1]

$$E = \sum_i \{s_i - g\delta(i-p)\}^2 \quad \text{(Equation 1)}$$

From equation 1 above, the pulse position to minimize the cost function is the position in which the absolute value $|s_p|$ of the input spectrum in each band is maximum, and its polarity is the polarity of the value of the input spectrum value at the position of that pulse.

An example case will be explained below where the vector length of an input spectrum is eighty samples, the number of bands is five, and the spectrum is encoded using eight pulses, one pulse from each band and three pulses from the entire band. In this case, the length of each band is sixteen samples. Further, the amplitude of pulses to search for is fixed to "1," and their polarity is "+" or "−."

Interval search section 121 searches for the position of the maximum energy and the polarity (+/−) in each band, and allows one pulse to occur per band. In this example, the number of bands is five, and each band requires four bits to show the pulse position (entries of positions: 16) and one bit to show the polarity (+/−), requiring twenty five information bits in total.

Figure 3:
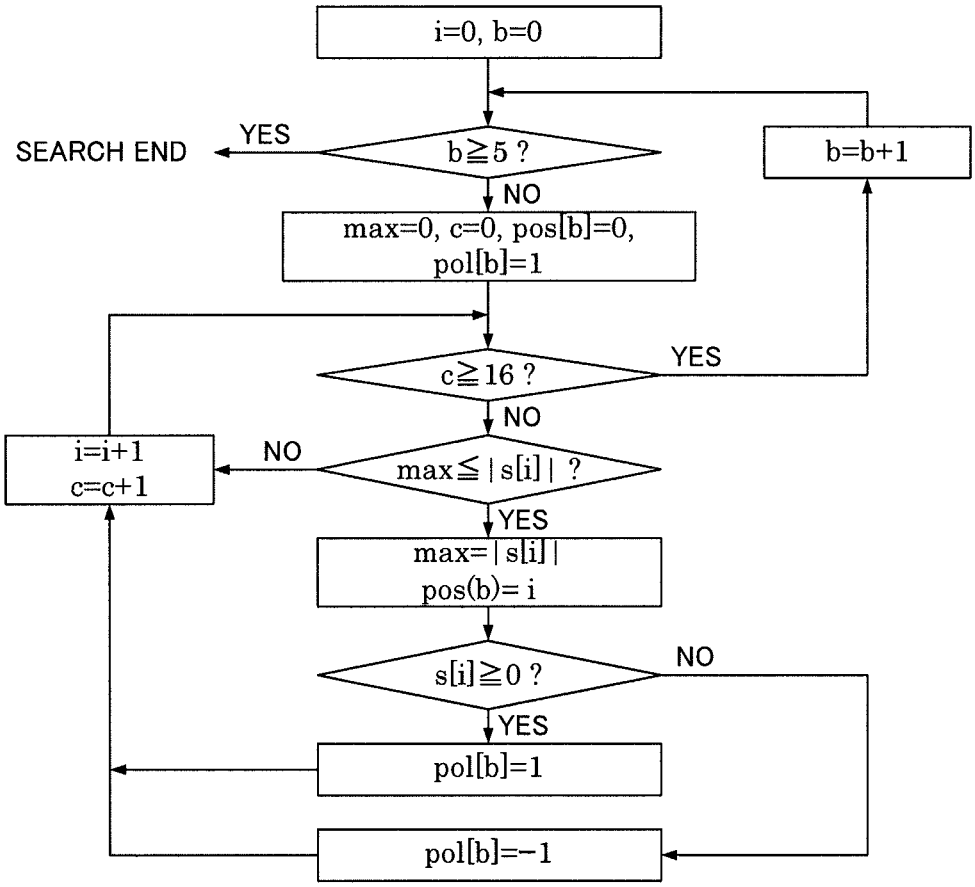
FIG. 3 is a flowchart showing the search algorithm in an interval search section according to an embodiment of the present invention.

The flow of the search algorithm of interval search section 121 is shown in FIG. 3. Here, the symbols used in the flowchart of FIG. 3 stand for the following contents.

i: position
b: band number
max: maximum value
c: counter
pos[b]: search result (position)
pol[b]: search result (polarity)
s[i]: input spectrum As shown in FIG. 3, interval search section 121 calculates the input spectrum s[i] of each sample (0≤c≤15) per band (0≤b≤4), and calculates the maximum value "max."

Figure 4:
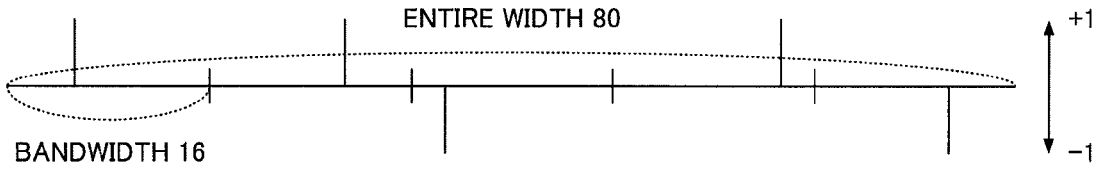
FIG. 4 is a diagram showing an example of a spectrum represented by pulses searched in an interval search section according to an embodiment of the present invention.

FIG. 4 illustrates an example of a spectrum represented by pulses searched out by interval search section 121. As shown in FIG. 4, one pulse having an amplitude of "1" and polarity of "+" or "−" occurs in each of five bands having a bandwidth of sixteen samples.

Thorough search section 122 searches for the positions raising three pulses, over the entire search interval, and encodes the positions and polarities of the pulses. In thorough search section 122, a search is performed according to the following four conditions for accurate position coding with a small amount of information bits and a small amount of calculations.

(1) Two or more pulses are not to occur in the same position. In this example, pulses are not to occur in the positions in which the pulse of each band is raised in interval search section 121. With this ingenuity, information bits are not used to represent the amplitude component, so that it is possible to use information bits efficiently.

(2) Pulses are searched for in order, on a one by one basis, in an open loop. During a search, according to the rule of (1), pulse positions having been determined are not subject to search.

(3) In a position search, a position in which a pulse had better not occur is also encoded as one piece of information (position).

(4) Given that gains are encoded on a per band basis, pulses are searched for by evaluating coding distortion with respect to the ideal gain of each band.

Thorough search section 122 performs the following two-step cost evaluation to search for a single pulse over the entire input spectrum. First, in the first step, thorough search section 122 evaluates the cost in each band and finds the position and polarity to minimize the cost function. Then, in the second stage, thorough search section 122 evaluates the overall cost every time the above search is finished in a band, and stores the position and polarity of the pulse to minimize the cost, as a final result. This search is performed per band, in order. Further, this search is performed to meet the above conditions (1) to (4). Then, when a search of one pulse is finished, assuming the presence of that pulse in the searched position, a search of the next pulse is performed. This search is performed until a predetermined number of pulses (three pulses in this example) are found, by repeating the above processing.

Figure 5:
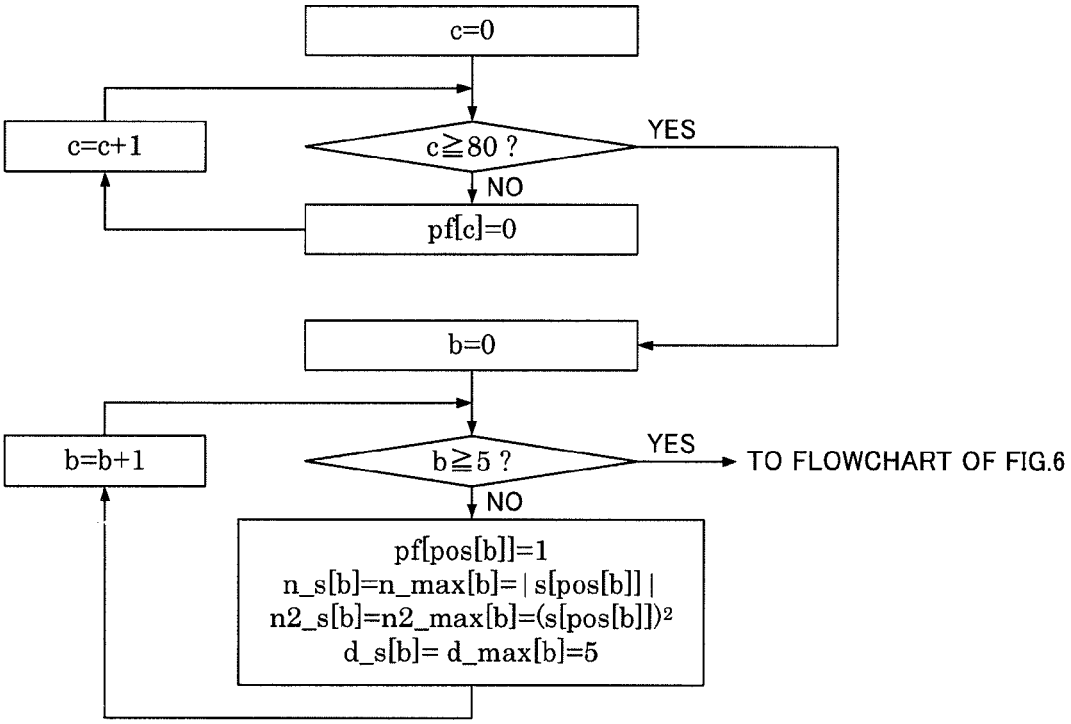
FIG. 5 is a flowchart showing the searching algorithm in a thorough search section according to an embodiment of the present invention.
Figure 6:
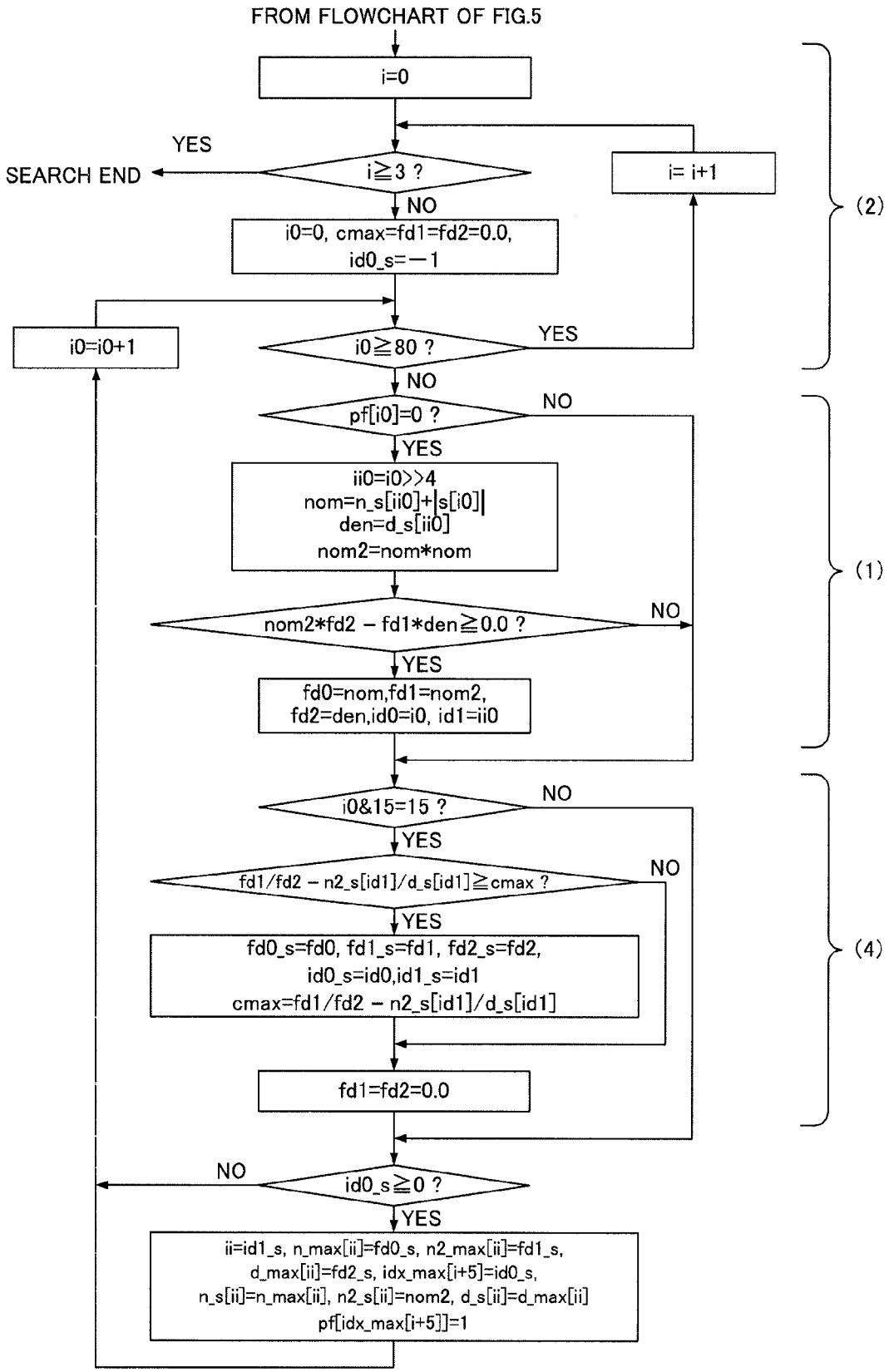
FIG. 6 is a flowchart showing the searching algorithm in a thorough search section according to an embodiment of the present invention.

The flow of the search algorithm of thorough search section 122 is shown in FIG. 5. FIG. 5 is a flowchart of preprocessing of a search, and FIG. 6 is a flowchart of the search. Further, the parts corresponding to the above conditions (1), (2) and (4) are shown in the flowchart of FIG. 6.

The symbols used in the flowchart of FIG. 5 stand for the following contents.

c: counter
pf[*]: pulse existence/nonexistence flag
b: band number
pos[*]: search result (position)
n_s[*]: correlation value
n_max[*]: maximum correlation value
n2_s[*]: square correlation value
n2_max[*]: maximum square correlation value
d_s[*]: power value
d_max[*]: maximum power value
s[*]: input spectrum The symbols used in the flowchart of FIG. 6 stand for the following contents.

i: pulse number
i0: pulse position
cmax: maximum value of cost function
pf[*]: pulse existence/nonexistence flag (0: nonexistence, 1: existence)
ii0: relative pulse position in a band
nom: spectral amplitude
nom2: numerator term (spectral power)
den: denominator term
n_s[*]: relative value
d_s[*]: power value
s[*]: input spectrum
n2_s[*]: square correlation value
n_max[*]: maximum correlation value
n2_max[*]: maximum square correlation value
idx_max[*]: search result of each pulse (position) (here, idx_max[*] of 0 to 4 is equivalent to pos[b] of FIG. 3)
fd0, fd1, fd2: temporary storage buffer (real number type)
id0, id1: temporary storage buffer (integral number type)
id0_s, id1_s: temporary storage buffer (integral number type)
>>: bit shift (to the right)
&: "and" as a bit sequence Here, in the search in FIG. 5 and FIG. 6, the case where idx_max[*] is "−1," corresponds to the above case of condition (3) where a pulse had better not occur. The detailed example of this is that, since a spectrum is sufficiently approximated only by the searched pulse per band and searched pulses in the entire interval, if a pulse of the same amplitude is raised in addition, a proportional increase of coding distortion is caused.

The polarities of the searched pulses correspond to the polarities of the input spectrum in these positions, and thorough search section 122 encodes these polarities with 3 (pulses)×1=3 bits. Here, when the position is "−1," that is, when a pulse does not occur, it makes no difference whether the polarity is "+" or "−." However, the polarity may be used to detect bit errors and generally is fixed to either "+" or "−."

Further, thorough search section 122 encodes pulse position information based on the number of combinations of pulse positions. In this example, since the input spectrum contains eighty samples and five pulses are already found in five individual bands, if cases where pulses are not raised are also taken into account, the variations of positions can be represented using seventeen bits, according to the calculation of following equation 2.

[2]

$$\begin{aligned} {}_{75+1}C_3 &= (75+1)*(74+1)*(73+1)/3/2/1 \\ &= 70300 \\ &< 131072 \\ &= 2^{\wedge}17 \end{aligned} \qquad \text{(Equation 2)}$$

Here, according to the rule of allowing two or more pulses not to occur in the same position, it is possible to reduce the number of combinations, so that the effect of this rule becomes greater when the number of pulses to search for in the entire interval increases.

The coding method based on the positions of pulses searched for in thorough search section 122 will be described below in detail.

(1) Three pulse positions are sorted based on their magnitude and arranged in order from the lowest numerical value to the highest numerical value. Here, "−1" is left as is.

(2) The pulse numbers are left-aligned by the number of pulses having occurred in individual bands, to reduce the numerical values of the pulse numbers. Numerical values calculated in this way are referred to as "position numbers." Here, "−1" is left as is. For example, referring to the pulse position of "66," when one pulse each is provided between 0 and 15, between 16 and 31, between 32 and 47, and between 48 and 64, the position number is changed to "66−4=62."

(3) "−1" is set to the position number represented by "the maximum value of a pulse +1." In this case, the order of values is adjusted and determined such that the set position number is not confused with a position number in which a pulse is actually present. By this means, the pulse number of pulse #0 is limited to the range between 0 and 73, the position number of pulse #1 is limited to the range between the position number of pulse #0 and 74, and the position number of pulse #2 is limited to the range between the position number of pulse #1 and 75, that is, the position number of a lower pulse is designed not to exceed the position number of a higher pulse.

(4) Then, according to integration processing shown in following equation 3 to calculate a combination code, position numbers (i0, i1, i2) are integrated to produce code (c). This integration processing is the calculation processing of integrating all combinations when there is the order of magnitude.

(Equation 3)

$$c=((76-0)*(77-0)*(153-2*0)/3+(74-0)*(75-0))/4-((76-i0)*(77-i0)*(153-2*i0)/3+(74-i0)*(75-i0))/4;$$

$$c=c+(76-i0)*(77-i0)/2-(76-i1)*(77-i1)/2;$$

$$c=c+75-i2; \qquad [3]$$

(5) Then, combining the 17 bits of this c and 3 bits for polarity, a code of 20 bits is produced.

Here, in the above-noted position numbers, pulse #0 of "73," pulse #1 of "74" and pulse #2 of "75" are position numbers in which pulses do not occur. For example, if there are three position numbers (73, −1, −1), according to the above-noted relationship between one position number and the position number in which a pulse does not occur, these position numbers are reordered to (−1, 73, −1) and made (73, 73, 75).

Thus, in the model where an input spectrum is represented by an 8-pulses sequence (five pulses in individual bands and three pulses in the entire interval) as shown in this example, it is possible to perform coding by 45 information bits.

Figure 7:
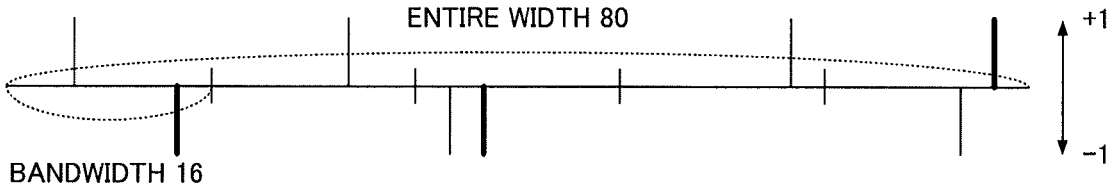
FIG. 7 is a diagram showing an example of a spectrum represented by pulses searched in an interval search section and thorough search section according to an embodiment of the present invention.

FIG. 7 illustrates an example of a spectrum represented by the pulses searched out in interval search section 121 and thorough search section 122. Also, in FIG. 7, the pulses represented by bold lines are pulses searched out in thorough search section 122.

Gain quantizing section 112 quantizes the gain of each band. Eight pulses are allocated in the bands, and gain quantizing section 112 calculates the gains by analyzing the correlation between these pulses and the input spectrum.

If gain quantizing section 112 calculates the ideal gains and then performing coding by scalar quantization or vector quantization, first, gain quantizing section 112 calculates the ideal gains according to following equation 4. Here, in equation 4, $g^n$ is the ideal gain of band "n," s(i+16 n) is the input spectrum of band "n," $v^n(i)$ is the vector acquired by decoding the shape of band "n."

[4]

$$g^n = \frac{\sum_i s(i+16n) \times v^n(i)}{\sum_i v^n(i) \times v^n(i)} \quad \text{(Equation 4)}$$

Further, gain quantizing section 112 performs coding by performing scalar quantization ("SQ") of the ideal gains or performing vector quantization of these five gains together. In the case of performing vector quantization, it is possible to perform efficient coding by prediction quantization, multi-stage VQ, split VQ, and so on. Here, gain can be heard perceptually based on a logarithmic scale, and, consequently, by performing SQ or VQ after performing logarithm transform of gain, it is possible to produce perceptually good synthesis sound.

Further, instead of calculating ideal gains, there is a method of directly evaluating coding distortion. For example, in the case of performing VQ of five gains, coding distortion is calculated to minimize following equation 5. Here, in equation 5, $E_k$ is the distortion of the k-th gain vector, s(i+16 n) is the input spectrum of band "n," $g_n^{(k)}$ is the n-th element of the k-th gain vector, and $v^n(i)$ is the shape vector acquired by decoding the shape of band "n."

[5]

$$E_k = \sum_n \sum_i \{s(i+16n) - g_n^{(k)} v^n(i)\} \quad \text{(Equation 5)}$$

Next, the method of decoding three pulses in spectrum decoding section 203, which are searched out by the thorough search, will be explained.

Figure 8:
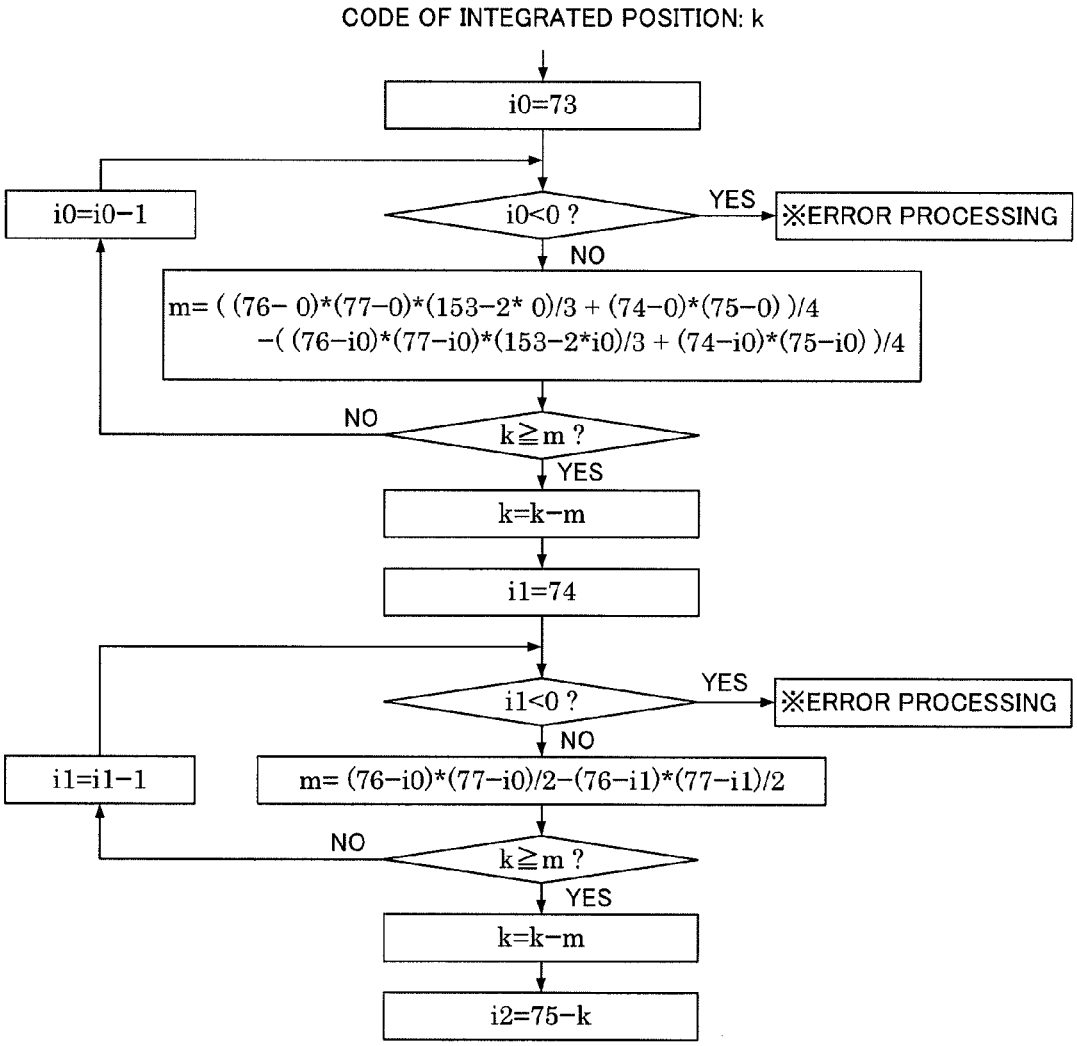
FIG. 8 is a flowchart showing the decoding algorithm in a spectrum decoding section according to an embodiment of the present invention.

In thorough search section 122 of spectrum coding section 105, position numbers (i0, i1, i2) are integrated to one code using above-described equation 3. In spectrum decoding section 203, reverse processing is performed. That is, spectrum decoding section 203 sequentially calculates the value of the integration equation while changing each position number, fixes the position number when the position number is lower than the integration value, and performs this processing from the position number of lower order to the position number of higher order one by one, thereby performing decoding. FIG. 8 is a flowchart showing the decoding algorithm of spectrum decoding section 203.

Further, in FIG. 8, when input code "k" of the integrated position involves error due to bit error, the flow proceeds to the step of error processing. Therefore, in this case, the position must be found by predetermined error processing.

Further, since the decoder has loop processing, the amount of calculations in the decoder is greater than in the encoder. Here, each loop is an open loop, and, consequently, seen from the overall amount of processing in the codec, the amount of calculations in the decoder is not quite large.

Thus, the present embodiment can accurately encode frequencies (positions) in which energy is present, so that it is possible to improve qualitative performance, which is unique to spectrum coding, and produce good sound quality even at low bit rates.

Further, although a case has been described above with the present embodiment where gain coding is performed after shape coding, the present invention can provide the same performance if shape coding is performed after gain coding. Further, it may be possible to employ a method of performing gain coding on a per band basis and then normalizing the spectrum by decoded gains, and performing shape coding of the present invention.

Further, although an example case has been described above with the present embodiment where, in quantization of the shape of a spectrum, the length of the spectrum is eighty, the number of bands is five, the number of pulses to search for on a per band basis is one and the number of pulses to search for in the entire interval is three, the present invention does not depend on the above values at all and can produce the same effects with different numerical values.

Further, if the bandwidth is sufficiently short, relatively many gains can be encoded and the number of information bits is sufficiently large, the present invention can achieve the above-described performance only by performing a pulse search on a per band basis or performing a pulse search in a wide interval over a plurality of bands.

Further, although the condition of not raising two pulses in the same position is set in the above-described embodiment, the present invention may partly relax this condition. For example, if the pulse to search for on a per band basis and pulses to search for in a wide interval over the plurality of bands, are allowed to occur in the same positions, it is possible to eliminate pulses of individual bands or allow pulses of double amplitude to occur. To relax that condition, the essential requirement is not to store pulse existence/nonexistence flag pf[*] with respect to the pulse per band. That is, "pf[pos[b]]=1" in the last step in FIG. 5 needs to be omitted. Alternatively, another method of relaxing that condition is not to store a pulse existence/nonexistence flag upon a pulse search in a wide interval. That is, "pf[idx_max[i+5]]=1" in the last step in FIG. 6 needs to be omitted. In this case, variations of positions increase. The combinations are not as simple as shown in the present embodiment, and therefore it is necessary to classify cases and encode the combinations according to the classified cases.

Further, although coding by pulses is performed for a spectrum subjected to an orthogonal transform in the present embodiment, the present invention is not limited to this, and is also applicable to other vectors. For example, the present invention may be applied to complex number vectors in the FFT or complex DCT, and may be applied to a time domain vector sequence in the Wavelet transform or the like. Further, the present invention is also applicable to a time domain vector sequence such as excitation waveforms of CELP. As for excitation waveforms in CELP, a synthesis filter is involved, and therefore a cost function involves a matrix calculation. Here, the performance is not sufficient by a search in an open loop when a filter is involved, and therefore a close loop search needs to be performed in some degree. When there are many pulses, it is effective to use a beam search or the like to reduce the amount of calculations.

Further, according to the present invention, a waveform to search for is not limited to a pulse (impulse), and it is equally possible to search for even other fixed waveforms (such as dual pulse, triangle wave, finite wave of impulse response, filter coefficient and fixed waveforms that change the shape adaptively), and produce the same effect.

Further, although a case has been described with the preset embodiment where the present invention is applied to CELP, the present invention is not limited to this but is effective with other codecs.

Further, not only a speech signal but also an audio signal can be used as the signal according to the present invention. It is also possible to employ a configuration in which the present invention is applied to an LPC prediction residual signal instead of an input signal.

The coding apparatus and decoding apparatus according to the present invention can be mounted on a communication terminal apparatus and base station apparatus in a mobile communication system, so that it is possible to provide a communication terminal apparatus, base station apparatus and mobile communication system having the same operational effect as above.

Although a case has been described with the above embodiment as an example where the present invention is implemented with hardware, the present invention can be implemented with software. For example, by describing the algorithm according to the present invention in a programming language, storing this program in a memory and making the information processing section execute this program, it is possible to implement the same function as the coding apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2007-053497, filed on Mar. 2, 2007, including the specification, drawings and abstract, is incorporated herein by reference in its entirety.

INDUSTRIAL APPLICABILITY

The present invention is suitable to a coding apparatus that encodes speech signals and audio signals, and a decoding apparatus that decodes these encoded signals.

The invention claimed is:

1. A coding apparatus that quantizes and encodes a frequency spectrum of a transformed residual component resulting from a linear predictive coding (LPC) inverse-filtering, with a shape vector which includes a plurality of pulses and a gain vector, the apparatus comprising:

an LPC analyzer that performs a linear prediction analysis of an input speech signal and outputs a spectral envelope parameter;

an inverse filter that inverse-filters the input speech signal using the spectral envelope parameter and outputs a residual component;

an orthogonal transformer that transforms the residual component into a frequency domain, and outputs the frequency spectrum of the transformed residual component;

a shape quantizer that divides the frequency spectrum of the transformed residual component into a plurality of sub-bands and performs a $1^{st}$ pulse search to determine a position and a sign of a $1^{st}$ pulse in each of the sub-bands, the position of the $1^{st}$ pulse having a largest amplitude in each of the sub-bands, and performs a $2^{nd}$ pulse search to determine positions and signs of $2^{nd}$ pulses in the frequency spectrum of the transformed residual component in all of the sub-bands, and encodes positions and signs of the $1^{st}$ pulses and the $2^{nd}$ pulses; and a gain quantizer that encodes the gain vector based on the $1^{st}$ pulses, the $2^{nd}$ pulses, and the frequency spectrum of the transformed residual component.

2. The coding apparatus according to claim 1, wherein the positions of the $2^{nd}$ pulses are not occupied by the $1^{st}$ pulses.

3. The coding apparatus according to claim 1, wherein a quantity of the sub-bands is 5.

4. The coding apparatus according to claim 1, wherein said shape quantizer encodes positions of the $2^{nd}$ pulses according to a procedure as follows:

$$c=((76-0)*(77-0)*(153-2*0)/3+(74-0)*(75-0))/4-((76-i0)*(77-i0)*(153-2*i0)/3+(74-i0)*(75-i0))/4;$$

$$c=c+(76-i0)*(77-i0)/2-(76-i1)*(77-i1)/2;$$

$$c=c+75-i2;\text{ where}$$

c: code of the positions of the $2^{nd}$ pulses; and i0, i1, i2: position numbers of $2^{nd}$ pulses.

5. A coding method of quantizing and encoding a frequency spectrum of a transformed residual component resulting from a linear predictive coding (LPC) inverse-filtering, with a shape vector which includes a plurality of pulses and a gain vector, the method comprising:

performing a linear prediction analysis of an input speech signal and outputting a spectral envelope parameter;

inverse-filtering the input speech signal using the spectral envelope parameter and outputting a residual component;

transforming the residual component into a frequency domain, and outputting the frequency spectrum of the transformed residual component;

dividing the frequency spectrum of the transformed residual component into a plurality of sub-bands and performing a $1^{st}$ pulse search to determine a position and a sign of a $1^{st}$ pulse in each of the sub-bands, the position of the $1^{st}$ pulse having a largest amplitude in each of the sub-bands, and performing a $2^{nd}$ pulse search to determine positions and signs of $2^{nd}$ pulses in the frequency spectrum of the transformed residual component in all of the sub-bands, and encoding positions and signs of the $1^{st}$ pulses and the $2^{nd}$ pulses; and encoding the gain vector based on the $1^{st}$ pulses, the $2^{nd}$ pulses, and the frequency spectrum of the transformed residual component.

6. The coding method according to claim 5, wherein the positions of the $2^{nd}$ pulses are not occupied by the $1^{st}$ pulses.

7. The coding method according to claim 5, wherein a quantity of the sub-bands is 5.

8. The coding method according to claim 5, wherein in the dividing, encoding positions of the $2^{nd}$ pulses according to a procedure as follows:

$$c=((76-0)*(77-0)*(153-2*0)/3+(74-0)*(75-0))/4-((76-i0)*(77-i0)*(153-2*i0)/3+(74-i0)*(75-i0))/4;$$

$$c=c+(76-i0)*(77-i0)/2-(76-i1)*(77-i1)/2;$$

$$c=c+75-i2;\text{ where}$$

c: code of the positions of the $2^{nd}$ pulses; and
i0, i1, i2: position numbers of $2^{nd}$ pulses.

* * * * *